US005816962A

United States Patent [19]

Etersque

[11] Patent Number: 5,816,962

[45] Date of Patent: Oct. 6, 1998

[54] HOCKEY STICK BLADE PROTECTOR

[76] Inventor: Michael Etersque, 247 W. 24th St., Deer Park, N.Y. 11729

[21] Appl. No.: 857,766

[22] Filed: May 16, 1997

Related U.S. Application Data

[63] Continuation-in-part of Ser. No. 631,798, Apr. 15, 1996, abandoned.

[51] Int. Cl.[6] ..... A63B 59/14

[52] U.S. Cl. ..... 473/563

[58] Field of Search ..... 473/560–563, 473/189

[56] References Cited

U.S. PATENT DOCUMENTS

| | | | |
|---|---|---|---|
| 2,912,245 | 11/1959 | Gardner et al. | 273/67 A |
| 3,529,825 | 9/1970 | White | 273/67 A |
| 3,982,760 | 9/1976 | Tiitola | 273/67 A |
| 5,294,113 | 3/1994 | Ladouceur et al. | 273/67 A |

FOREIGN PATENT DOCUMENTS

| | | | |
|---|---|---|---|
| 755982 | 4/1967 | Canada | 473/188 |
| 3238117 | 6/1983 | Germany | 473/189 |

*Primary Examiner*—Mark S. Graham

[57] ABSTRACT

A new hockey stick blade protector for protecting the blade of a hockey stick and further reducing the friction of the blade on the playing surface improving a hockey player's performance. The inventive device includes at least one protective wear member molded to the shape of a hockey stick blade and coupled to the hockey stick blade by an attaching means where at least one protective wear member is contiguous to the playing surface to prevent wearing of the hockey stick blade and to reduce friction.

10 Claims, 5 Drawing Sheets

FIG 5
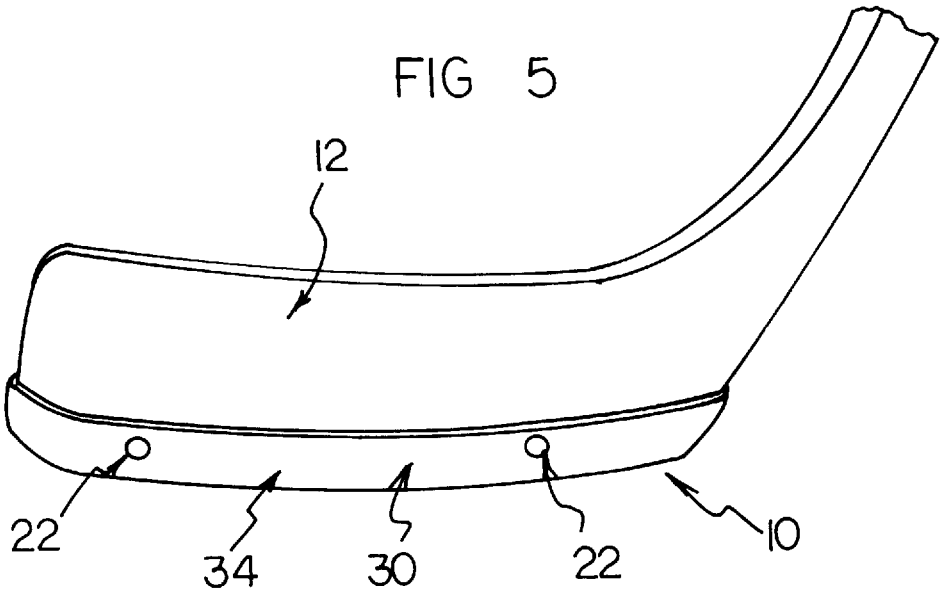
FIG 6
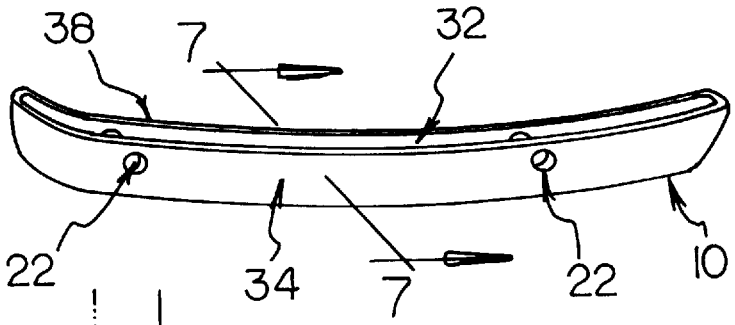
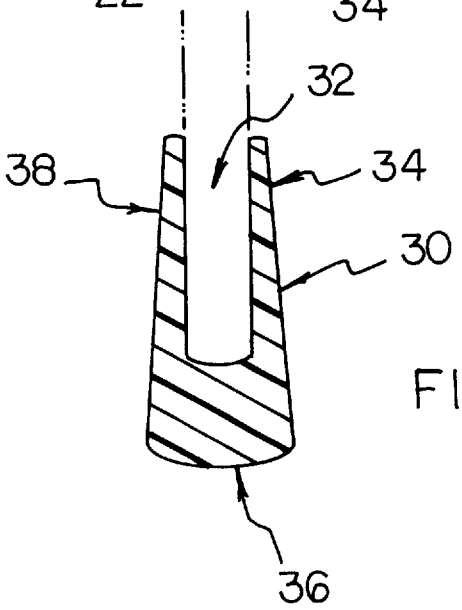
FIG 7

FIG 8
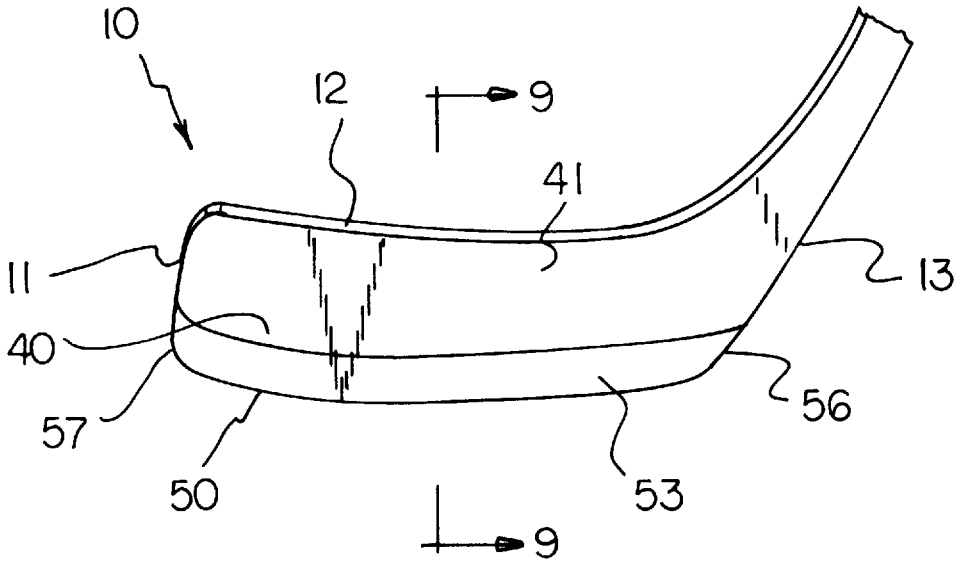
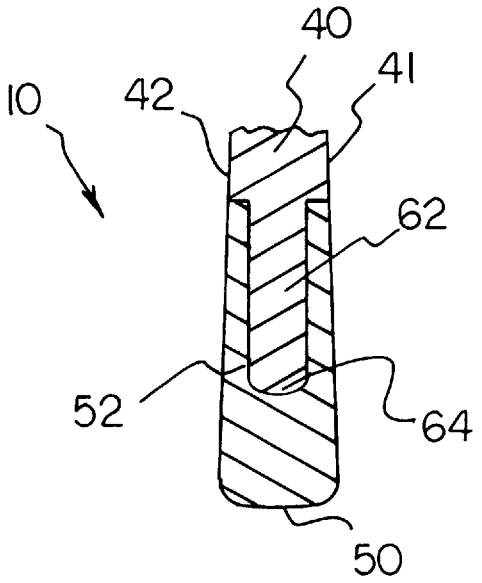
FIG 9
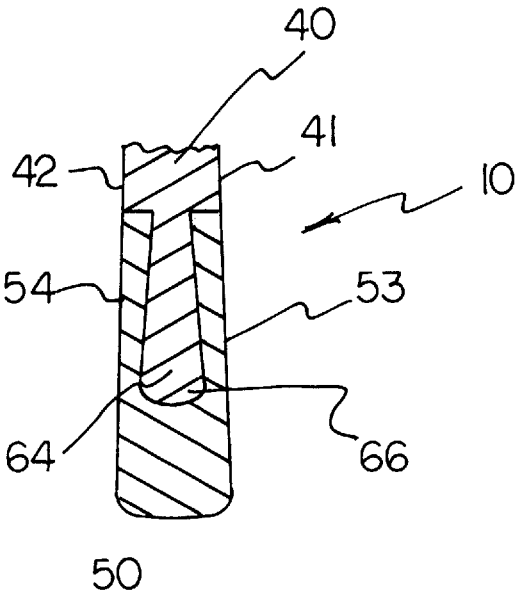
FIG 10

FIG 11
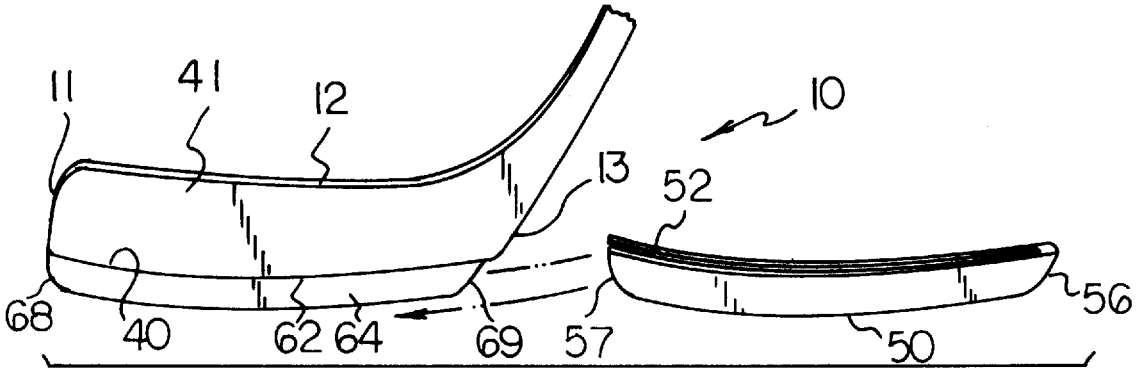
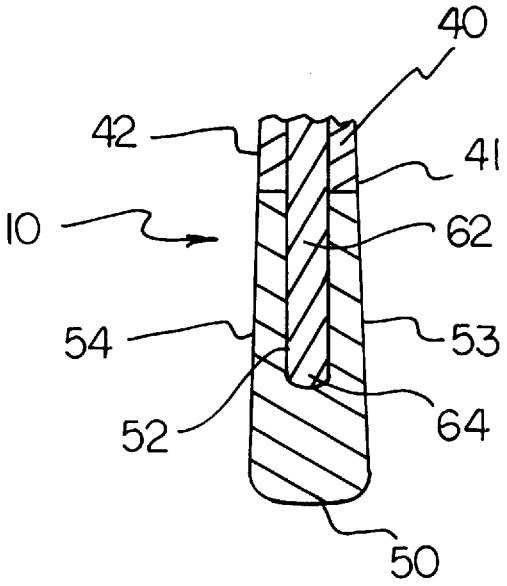
FIG 12
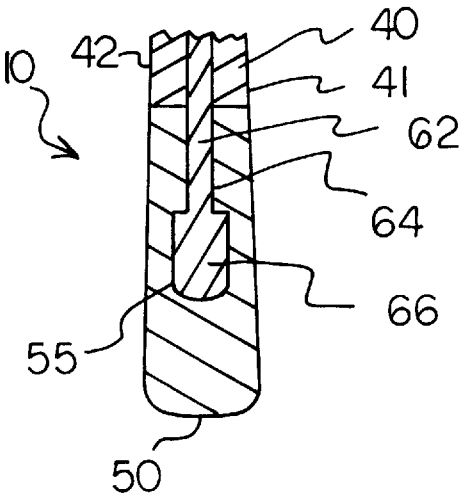
FIG 13

HOCKEY STICK BLADE PROTECTOR

CROSS REFERENCE TO RELATED APPLICATION

This application is a continuation-in-part of my prior utility patent application Ser. No. 08/631,798, filed Apr. 15, 1996, abandoned.

BACKGROUND OF THE INVENTION

1. Field of the Invention

The present invention relates to hockey stick protective devices and more particularly pertains to a new hockey stick blade protector for protecting the blade of a hockey stick extending the life of the hockey stick and reducing the friction of the blade on the playing surface improving a hockey player's performance.

2. Description of the Prior Art

The use of hockey stick protective devices is known in the prior art. More specifically, hockey stick protective devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art hockey stick protective devices include U.S. Pat. No. 5,294,113; U.S. Pat. No. 4,651,990; U.S. Pat. No. 4,452,451; U.S. Pat. No. 4,382,616; U.S. Pat. No. 4,392,674; U.S. Design Pat. No. 258,604; U.S. Pat. No. 3,529,825; U.S. Pat. No. 3,982,760; and U.S. Pat. No. 2,912,245.

While these devices fulfill their respective, particular objectives and requirements, the aforementioned patents do not disclose a new hockey stick blade protector. In particular, the invention disclosed in U.S. Pat. No. 5,294,113 utilizes a universal plastic strip to compensate for the various hockey stick blades which have various thickness' and lengths. However, this design is not secure and is designed only to be put on while playing street hockey and removed when playing ice hockey.

Also in particular, the invention disclosed U.S. Pat. No. 3,982,760 uses an ABS plastic strip inside the a laminated hockey stick blade. However, the laminated blade wears and splinters with use requiring the entire blade to be replaced and not just the ABS plastic. The blade disclosed in the U.S. Pat. No. 3,982,760 slows the wearing process but still requires the replacement of the entire hockey stick when the plastic is worn out. The U.S. Pat. No. 3,982,760 also does not disclose an invention that includes a replaceable blade system.

The inventive device includes at least one protective wear member molded to the shape of a hockey stick blade and coupled to the hockey stick blade where at least one protective wear member is contiguous to the playing surface to prevent wearing of the hockey stick blade and to reduce friction. The inventive device further includes an attaching means for simple attachment to the hockey stick blade.

In these respects, the hockey stick blade protector according to the present invention substantially departs from the conventional concepts and designs of the prior art, and in so doing provides an apparatus primarily developed for the purpose of protecting the blade of a hockey stick extending the life of the hockey stick and reducing the friction of the blade on the playing surface improving a hockey player's performance.

SUMMARY OF THE INVENTION

In view of the foregoing disadvantages inherent in the known types of hockey stick protective devices now present in the prior art, the present invention provides a new hockey stick blade protector construction wherein the same can be utilized for protecting a hockey stick blade of a hockey stick extending the life of the hockey stick and reducing the friction of the blade on a playing surface improving a hockey player's performance. As such, the general purpose of the present invention, which will be described subsequently in greater detail, is to provide a new hockey stick blade protector apparatus and method which has many of the advantages of the hockey stick protective devices mentioned heretofore and many novel features that result in a new hockey stick blade protector which is not anticipated, rendered obvious, suggested, or even implied by any of the prior art hockey stick protective devices, either alone or in any combination thereof.

To attain this, the present invention generally comprises at least one protective wear member molded to the shape of a hockey stick blade and coupled to the hockey stick blade where at least one protective member is contiguous to the playing surface to prevent wearing of the hockey stick blade and to reduce friction. The inventive device further includes an attaching means for simple attachment to the hockey stick blade.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hockey stick blade protector apparatus and method which has many of the advantages of the hockey stick protective devices mentioned heretofore and many novel features that result in a new hockey stick blade protector which is not anticipated, rendered obvious, suggested, or even implied by any of the prior art hockey stick protective devices, either alone or in any combination thereof.

It is another object of the present invention to provide a new hockey stick blade protector which may be easily and efficiently manufactured and marketed.

It is a further object of the present invention to provide a new hockey stick blade protector which is of a durable and reliable construction.

An even further object of the present invention is to provide a new hockey stick blade protector which is susceptible of a low cost of manufacture with regard to both materials and labor, and which accordingly is then susceptible of low prices of sale to the consuming public, thereby making such hockey stick blade protector economically available to the buying public.

Still yet another object of the present invention is to provide a new hockey stick blade protector which provides in the apparatuses and methods of the prior art some of the advantages thereof, while simultaneously overcoming some of the disadvantages normally associated therewith.

Still another object of the present invention is to provide a new hockey stick blade protector for protecting and extending the life of the hockey stick blade.

Another object of the present invention is to reduce the friction of the blade on the playing surface improving a hockey player's performance.

Yet another object of the present invention is to provide a new hockey stick blade protector which includes at least one protective wear member molded to the shape of a hockey stick blade coupled to the hockey stick blade where at least one protective wear member is contiguous to the playing surface to prevent wearing of the hockey stick blade.

The inventive device further includes an attaching means for simple attachment to the hockey stick blade that can be used to play street hockey and ice hockey.

Even still another object of the present invention is to provide a new hockey stick blade protector wherein the user is able to attach the invention to a hockey stick blade to prevent the wearing of the blade which extends the hockey stick's useful life and that is easily replaceable without requiring the replacement of the entire hockey stick.

Another object of the present invention is to provide a new hockey stick blade protector that allows rigid hockey blades of made of fiberglass and wood laminations to be used in street hockey instead of less preferred hockey sticks with plastic blades.

Even further another object of the present invention is to reduce the friction between the invention and the playing surface increases the user's shooting ability and allows the user to slide the hockey stick while skating without causing undue drag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a rear perspective view of another embodiment of a single protective wear member of the hockey stick blade protector mounted on a hockey stick blade.

FIG. 6 is a rear perspective view of the single protective wear member of FIG. 5.

FIG. 7 is a cross-section view taken along line 7—7 of FIG. 6.

FIG. 8 is a side view of a variation of the present invention.

FIG. 9 is a sectional view taken along line 9—9 of FIG. 8.

FIG. 10 is a variant sectional view showing a tongue flange tapering towards the hockey stick blade bottom portion.

FIG. 11 is an exploded side view of a variant of the present invention showing how the protective wear member is slidably mounted on the tongue flange.

FIG. 12 is a variant sectional view showing a tongue flange as a separate member.

FIG. 13 is a variant sectional view showing a tongue flange with a flared lower portion.

DESCRIPTION OF THE PREFERRED EMBODIMENT

Figures 1, 2:
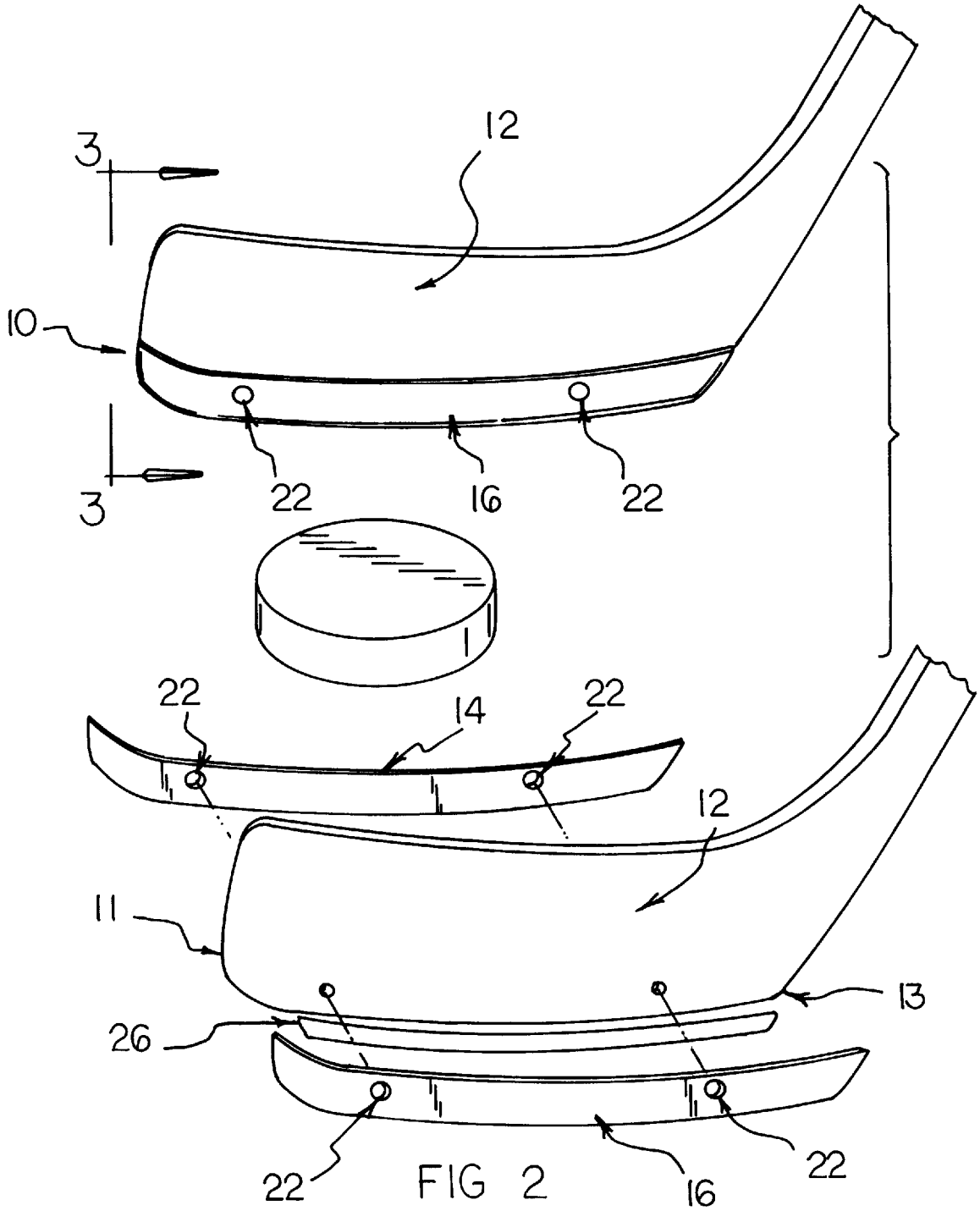
FIG. 1 is a rear perspective view of the new hockey stick blade protector according to the present invention.
FIG. 2 is a rear exploded perspective view of the hockey stick blade protector of FIG. 1.
Figure 3:
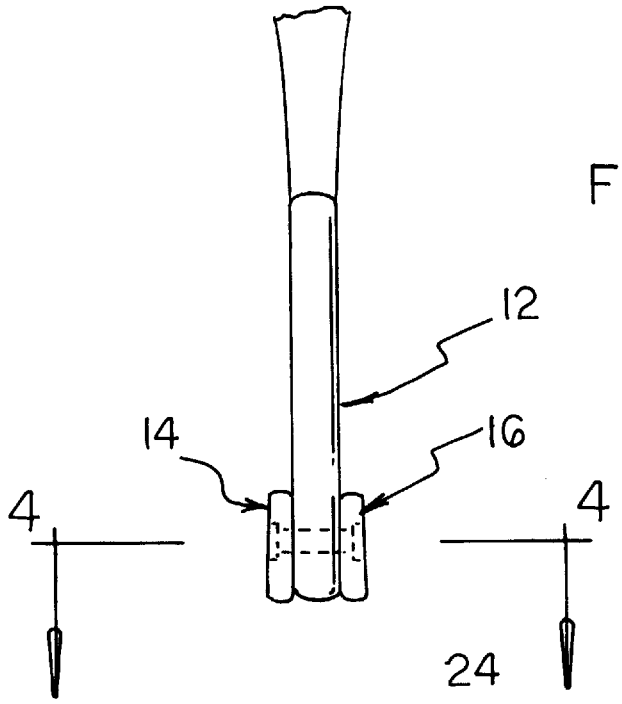
FIG. 3 is a right side view of the hockey stick blade protector of FIG. 1.
Figure 4:
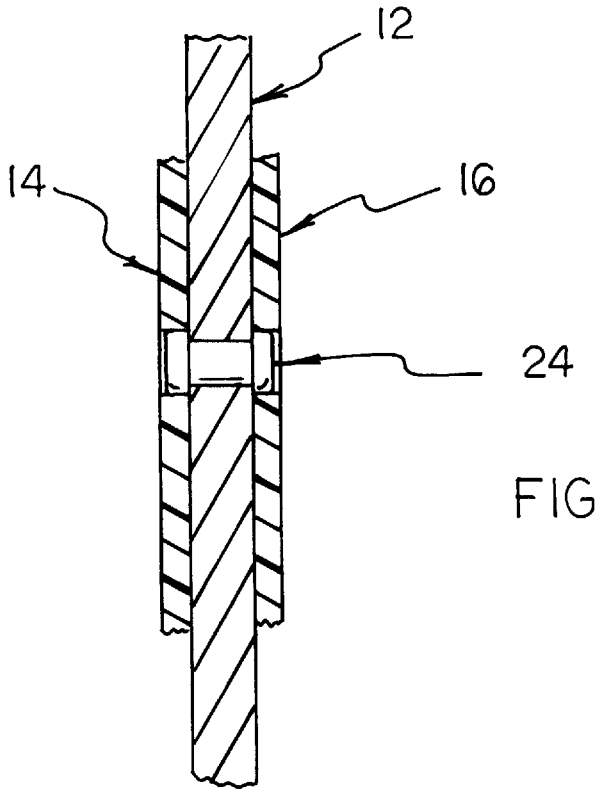
FIG. 4 is a cross-section view taken along line 4—4 of FIG. 3.

With reference now to the drawings, and in particular to FIGS. 1–13 thereof, a new hockey stick blade protector embodying the principles and concepts of the present invention and generally designated by the reference numeral 10 will be described.

More specifically, it will be noted that the hockey stick blade protector 10 comprises a back protective wear member 14, a front protective wear member 16, and an attaching means 20.

As best illustrated in FIGS. 1 and 2, it can be shown that the present invention 10 comprises the front protective wear member extending from a hockey stick blade toe 11 along the lower portion of a hockey stick blade 12 ending at a hockey stick blade heel 13. The front protective wear member 16 is molded so as to conform to the contours of the hockey stick blade 12 to allow precise attachment to the hockey stick blade 12. FIG. 2 discloses the back protective wear member 14 which is aligned opposite of the front protective wear member 16 and extending from the hockey stick blade toe 11 along the lower portion of the hockey stick blade 12 terminating at the hockey stick blade heel 13. The unnumbered attaching means comprising an adhesive strip 26 securing the front protective wear member 16 and the back protective wear member 14 to the said hockey stick blade 12. An alternative attaching means, as shown in FIGS. 1 through 4, wherein the front protective wear member 16, the back protective wear member 14, and the hockey stick blade 12 further comprise at least one attachment aperture 22. A fastener member 24 is fastened through each corresponding attachment aperture 22 of the front protective wear member 16, of the hockey stick blade 12 and of the back protective wear member 14 attaching said invention 10 to the hockey stick blade 12 where the said fastener member 24 is flush to the facial surfaces of the front protective wear member 16 and the back protective wear member 14 so as not to interfere with shooting of a hockey puck 18 or hockey ball (not shown).

In another embodiment of the present invention 10, shown in FIGS. 5 through 7, demonstrating a single protective wear member or strip 30 extending from the hockey stick blade toe 11 along the lower portion of the hockey stick blade 12 ending at the hockey stick blade heel 13. The single protective wear member 30 comprising a front protecting side wall 34, an arcuate protecting bottom wall 36, and a back protecting side wall 38 defining a U-shaped blade receiving groove 32 molded so as to conform to the contours of the hockey stick blade 12 to allow precise attachment to the hockey stick blade 12. The attaching means comprising adhesive strip 26 affixing the single protective wear member 30 to the hockey stick blade 12. An alternative attaching means 20 wherein the single protective wear member 30 comprising at least two corresponding attachment aperture 22 through the front protecting side wall 34, the back protecting side wall 38 and the hockey stick blade 12. The fastener member 24 is fastened through each corresponding attachment aperture 22 of the single protective wear member 30 and of the hockey stick blade 12 for attaching said invention 10 to the hockey stick blade 12 where the fastener member 24 is tangent to the facial surfaces of the front protecting side wall 34 and the back protecting side wall 38 so as not to interfere with shooting of the hockey puck 18 or hockey ball (not shown).

In use, the hockey stick blade protector 10 according to the present invention can be easily utilized to protect of the hockey stick blade from damage and further to reduce the friction between the present invention 10 and the playing surface to allow an unobstructed shot with the hockey puck 18. The device 10 can be easily affixed to the hockey stick blade 12 by using either the adhesive strip 26, or by creating at least one attachment aperture 22 in the hockey stick blade 12 which correspond to attachment aperture 22 of the present invention 10 wherein the fastener member is inserted through attachment aperture 22.

FIGS. 8 through 13 disclose another variation of the hockey stick blade protector 10. In this variation, a tongue flange 42 extends along the length of the bottom edge portion 40 of the hockey stick blade 12. Preferably, the lower end portion 64 of the tongue flange 62 is extended away from the hockey stick blade bottom edge portion 40.

The protective wear member 30 in this variant is an elongate protective strip 50. The protective strip 50 has a tongue flange receiving groove 52. The protective strip 50 is slidably mounted to the hockey stick blade bottom portion 40 by insertion of the tongue flange 62 into the tongue flange receiving groove 52. This also permits easy replacement of a worn protective slip 50 with a new protective slip by simply slidably detaching the worn protective strip 50 the from the hockey stick blade bottom portion 40. Also ideally, the protective strip 50 of this variation is made of a material that is flexible enough to fit on hockey stick blades 12 having curved front and back surfaces 41,42.

Preferably, in this variation, the protective strip is mounted to the hockey stick blade 12 so that the protective strip front surface 53 and the hockey stick blade front surface 41 are in a substantially similar plane. Similarly, it is also preferable that the protective strip back surface 54 and the hockey stick blade back surface 42 are in a substantially similar plane in this variation. This permits the hockey stick blade protector 10 to be flush with the hockey stick blade 12 to avoid causing any mishandling of a hockey puck or ball by the contours of the protective wear member 50.

Also preferably, the tongue flange 62 is frictionally held within the protective strip tongue flange receiving groove 52 so that no other fastening means is necessary to secure the protective strip 50 to the hockey stick blade 12. For added security, it is beneficial to have the tongue flange 62 is tapered from the tongue flange lower portion 64 towards the hockey stick blade bottom portion 40 to further help hold the tongue flange 62 within the protective strip tongue flange receiving groove 52.

Optionally, as shown in FIG. 13, the tongue flange lower portion 64 can include a flared end region 66 which fits within a flared end receiving region 55 when the tongue flange 62 is inserted into the protective strip tongue flange receiving groove 52 to help hold the tongue flange 62 within the protective strip tongue flange receiving groove 52.

Preferably, the protective strip 52 has a closed end 56 and an open end 57 so that tongue flange receiving groove 52 extends from the open end 57 towards the closed end 56. When the protective slip 52 is mounted on the hockey stick blade 12 the tongue flange 62 is inserted into the tongue flange receiving groove 62 so such that the tongue flange heel end 69 is positioned adjacent the protective strip closed end 56 and so that the tongue flange toe end 68 is aligned flush with the hockey stick blade toe 11 and the toe end 69 of the tongue flange 62. This configuration helps hold the protective strip in proper position on the hockey strip blade bottom portion 40.

Ideally, the protective strip is made of ultra-high molecular weight polyethylene which has the highest wear resistance compared to PVC or ABS plastics.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hockey stick blade protector for protecting the front and back faces of a hockey stick blade of a hockey stick, comprising:

a pair of separate substantially flat protective wear members for separately mounting on the face of a hockey stick blade, each said protective wear member comprising an elongate protective strip each mountable on the face of a hockey blade stick separate of the other said protective strip, said substantially flat protective strip being formed of a flexible plastic and being mountable independent of the other said strip such that said protective strip has a flexible character along its length to permit said strip to conform to the contour of the face of the hockey stick blade; and an attaching means on each said protective strip for removably fastening each protective wear strip to a hockey stick blade of a hockey stick, each said attaching means comprising an adhesive structure being adhered on one surface of a said substantially flat protective strip for placement against the face of the hockey stick blade.

2. The hockey stick blade protector of claim 1, wherein one of said pair of substantially flat protective strips comprises a front protective wear member adapted to extend from a hockey stick blade toe along a lower portion of the hockey stick blade terminating at a hockey stick blade heel in a substantially flush relationship with a bottom edge of said hockey stick blade.

3. The Hockey Stick Blade Protector of claim 2, wherein the other of said pair of substantially flat protective strips comprises a substantially flat back protective wear member which extends from the hockey stick blade toe along the lower portion of the hockey stick blade terminating at the hockey stick blade heel aligning opposite of the front protective wear member.

4. The Hockey Stick Blade Protector of claim 3, wherein the front protective wear member and the back protective wear member are constructed from a resilient wear resistant plastic formed to the curvature of the hockey stick blade.

5. The Hockey Stick Blade Protector of claim 4, wherein the adhesive structure comprises an adhesive strip for affixing the front protective wear member and the back protective wear member to the hockey stick blade.

6. The Hockey Stick Blade Protector of claim 4, wherein the front protective wear member and the back protective wear member each additionally comprises at least one attachment aperture extending therethrough to allow coupling to the hockey stick blade.

7. The Hockey Stick Blade Protector of claim 6, wherein the attaching means additionally comprises a fastener member to secure the front protective wear member and the back protective wear member to the hockey stick blade.

8. A hockey stick blade protector assembly comprising:

a hockey stick having a blade with front and back faces, front and rear protective strips, each said protective strip being substantially flat to permit said protective strip to flex and conform to the varying contours of the hockey blade face, and each said protective strip being adapted to extend outwardly from the face of a said hockey stick blade on which said strip is mounted to substantially block contact between said face and a hockey puck struck with said hockey stick, each said protective strip extending from the hockey blade stick toe along the lower portion of the hockey stick blade and terminating at the hockey stick blade heel, each said protective strip being mounted on a said face separately from the other said protective strip with no connecting structure extending therebetween to thereby permit varying hockey stick blade thickness' to be accommodated between the front and back protective strips; and attaching means fastening each protective wear member to the hockey stick blade of said hockey stick, each attaching means comprising an adhesive strip located between each protective strip and a face of the hockey stick blade to adhesively attach said protective strip to said face of said hockey stick.

9. A hockey stick blade protection device for protecting the bottom edge of a hockey stick from wear, comprising:

a hockey stick having a hockey stick blade, said hockey stick blade having a bottom edge portion a front surface, and a back surface;

a tongue flange having a lower end portion, said tongue flange being extended along the length of said hockey stick blade bottom edge portion, said tongue flange lower end portion being extended from said hockey stick blade bottom edge portion; and an elongate protective strip having a tongue flange receiving groove, a front surface and a back surface, said tongue flange being inserted into said tongue flange receiving groove such that said protective strip is slidably mounted to said hockey stick blade bottom portion;

wherein said tongue flange has a hockey stick blade toe end and a hockey stick blade heel end, and wherein said protective strip has a closed first end and an open second end, said protective strip tongue flange receiving groove being extended from said open second end towards said closed first end, said tongue flange being inserted into said protective strip tongue flange receiving groove such that said tongue flange hockey stick blade heel end is positioned adjacent said protective strip closed first end.

10. A hockey stick blade protection device for protecting the bottom edge of a hockey stick from wear, comprising:

a hockey stick having a hockey stick blade, said hockey stick blade having a bottom edge portion, a front surface, and a back surface;

a tongue flange having a lower end portion, said tongue flange being extended along the length of said hockey stick blade bottom edge portion, said tongue flange lower end portion being extended from said hockey stick blade bottom edge portion; and an elongate protective strip having a tongue flange receiving groove, a front surface and a back surface, said tongue flange of said hockey stick blade being inserted into said tongue flange receiving groove of said protective strip with said protective strip slidably mounted about the tongue flange of said hockey stick blade such that said tongue flange reinforces said protective strip against breakage;

wherein said tongue flange has a hockey stick blade toe end and a hockey stick blade heel end, and wherein said protective strip has a closed first end and an open second end, said protective strip tongue flange receiving groove being extended from said open second end towards said closed first end, said tongue flange being inserted into said protective strip tongue flange receiving groove such that said tongue flange hockey stick blade heel end is positioned adjacent said protective strip closed first end.

* * * * *